United States Patent [19]

Brown et al.

[11] 4,356,466

[45] Oct. 26, 1982

[54] ELECTROMAGNETIC SOLENOID RELAY

[75] Inventors: Samuel J. Brown, South Lyon; Jerome L. Lorenz, Birmingham, both of Mich.

[73] Assignee: Essex Group, Inc., Fort Wayne, Ind.

[21] Appl. No.: 265,864

[22] Filed: May 21, 1981

[51] Int. Cl.[3] ..... H01H 51/06; H01H 1/12

[52] U.S. Cl. ..... 335/203; 335/131; 335/196

[58] Field of Search ..... 335/203, 270, 262, 82, 335/81, 131, 126, 196, 202, 251, 255

[56] References Cited

U.S. PATENT DOCUMENTS

| | | | |
|---|---|---|---|
| 2,057,380 | 10/1936 | Keefe | 335/180 |
| 3,211,875 | 10/1965 | Bengtsson | 200/275 |
| 3,524,153 | 8/1970 | Little | 335/202 |
| 4,003,011 | 1/1977 | Hayden | 335/196 |
| 4,044,322 | 8/1977 | Brown et al. | 335/131 |
| 4,064,470 | 12/1977 | Hayden | 335/196 |

*Primary Examiner*—Harold Broome

*Attorney, Agent, or Firm*—Robert D. Sommer

[57] ABSTRACT

An electromagnetic solenoid relay in which the plunger armature is biased to its at-rest position by a spring of strip metal having an arcuate portion extending between an anchorage portion and an arm portion in engagement with the armature. The armature and spring are relatively loosely held together in operative relation to permit ready alignment of the armature with the relay electromagnet. A movable contact on the spring at one end of the armature cooperates with a stationary contact on a terminal of ferromagnetic material which forms a portion of the electromagnet magnetic flux path to provide a magnetic blow-out effect. The ferromagnetic bracket of the electromagnet is employed to retain major component parts of the relay in assembled relation.

6 Claims, 3 Drawing Figures

FIG. A
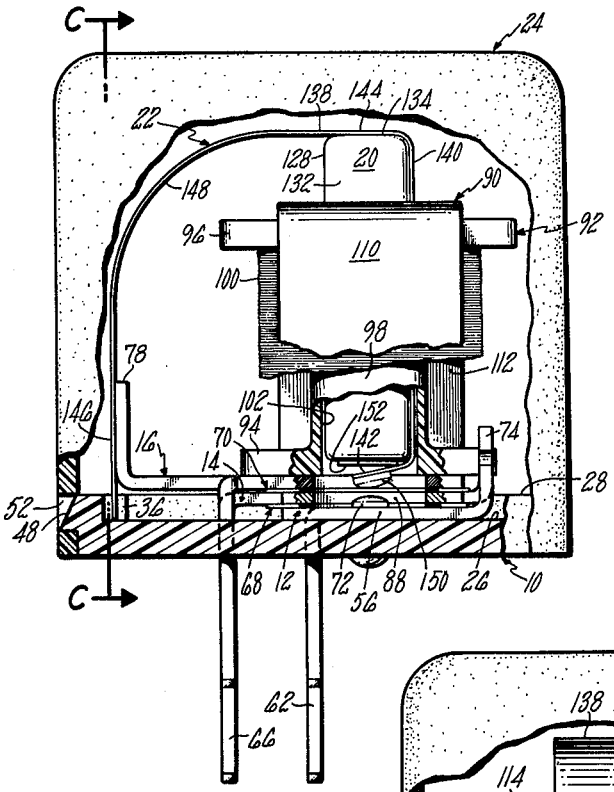
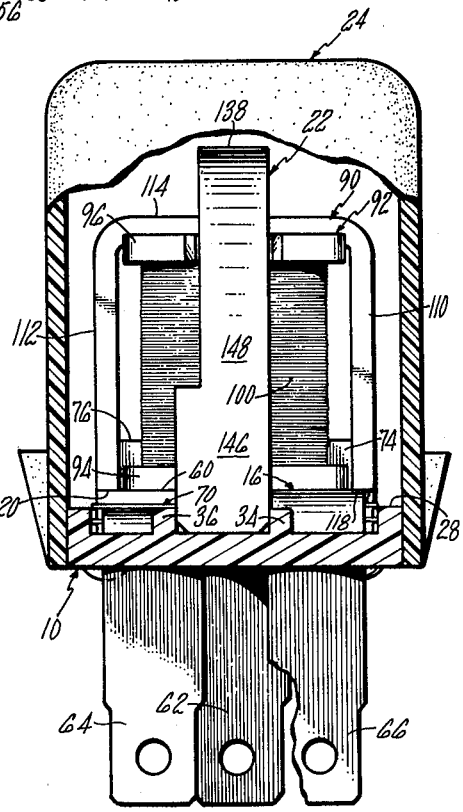
FIG. C

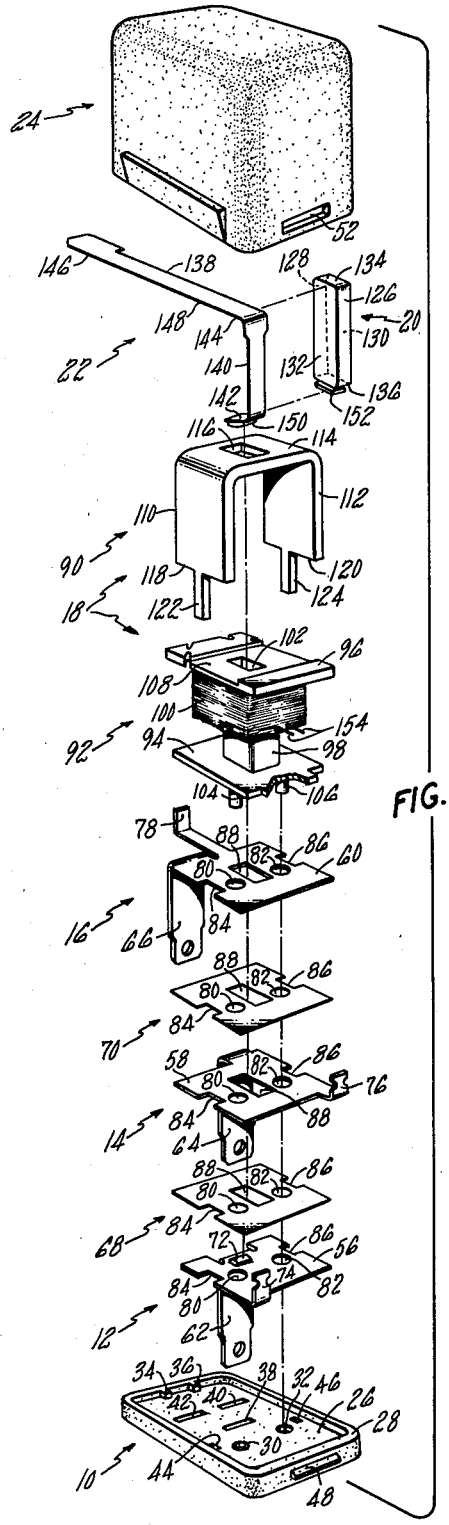
FIG. B

ELECTROMAGNETIC SOLENOID RELAY

BACKGROUND OF THE INVENTION

This invention relates in general to electromagnetic solenoid relays and in particular to relays of the type wherein a plunger armature is biased to its at-rest position by a flat spring which defines a curve between one end in engagement with the armature and another end anchored to the relay base.

Solenoid relay constructions employing a curved spring for biasing a plunger armature to its at-rest position are disclosed, for example, in the Hayden U.S. Pat. Nos. 4,003,011 and 4,064,770. In these prior relay constructions, the spring is rigidly secured to one end of the armature and tends to tilt or cock the armature relative to the bore of the electromagnet in which the armature is slidably supported for linear reciprocation. Such tilting is undesirable since it restricts the armature from properly aligning itself with the electromagnet and can result in binding of the armature within the electromagnet bore.

Another disadvantage of these prior relay constructions for high current switching applications is that there is no provision for the magnetic blowout of arcs established at the relay contacts. It is well known, of course, that the magnetic flux produced by the electromagnet of a solenoid relay may be employed to provide a magnetic blowout effect at the relay contacts. The Keefe U.S. Pat. No. 2,057,380 and the Brown et al. U.S. Pat. No. 4,044,322, for instance, each disclose the location of relay contacts in a magnetic flux path extending from the relay armature to a stationary component of the relay electromagnet.

For many relay applications, it is desirable to provide a compact relay of high reliability and low manufacturing cost. To attain this objective, various relay constructions have been proposed which minimize the number of parts and assembly operations required in manufacture of a relay. Examples of such approaches which attempt to minimize the number of parts and assembly operations are disclosed by the Bengtsson U.S. Pat. No. 3,211,875, the Little U.S. Pat. No. 3,524,153 and the aforementioned Hayden U.S. Pat. No. 4,003,011.

SUMMARY OF THE INVENTION

Accordingly, the general object of the present invention is to provide an improved solenoid relay of the type employing a curved spring for biasing the relay armature to its at-rest position which utilizes the well-known magnetic blowout effect to provide increased current interrupting capacity yet is compact in size, reliable in operation and of a low manufacturing cost.

In accordance with the present invention, the plunger armature of the improved solenoid relay is biased to its at-rest position by a curved spring of strip metal which is held in operative relation with the armature with a freedom of motion that permits the armature to align itself with the relay electromagnet upon energization of the electromagnet coil. The electromagnet is mounted on a base and has a bore therethrough in which the armature is slidably supported. The spring has an arcuate portion extending between an anchorage portion fixed to the base and an arm portion extending to an overlying one end of the armature. The spring further includes an extension portion extending at substantially a right angle from its arm portion in the electromagnet bore and disposed substantially parallel with one side of the armature. The extension portion of the spring terminates in an integral hook portion overlying the other end of the armature. The armature is axially constrained between the arm and hook portions of the spring such that the spring is effective to urge the armature to its at-rest position when the electromagnet coil is deenergized. The armature and spring are thus held together in operative relation solely by abutting engagement therebetween to provide a freedom of motion therebetween.

Also according to the present invention, the improved relay includes terminals mounted upon the base for connection in a relay controlled circuit. A first terminal carries a first contact and a second terminal is fixed to the anchorage portion of the curved spring. The hook portion of the spring carries a second contact arranged to engage the first contact upon movement of the armature to its actuated position. The relay electromagnet includes a bobbin upon which the electromagnet coil is wound and defines the bore in which the armature is slidably supported. The electromagnet further includes a substantially U-shaped ferromagnetic bracket having a pair of parallel leg portions extending from the base alongside the bobbin and joined by a bight portion overlying one end of the bobbin. The first terminal is located between the legs of the bracket and is formed of a ferromagnetic material to complete a magnetic flux path extending through the bracket, the armature and the terminal when the coil is energized. By thus locating the first and second contacts in a gap in the flux path between the first terminal and the armature, the magnetic blowout effect is advantageously utilized to provide increased current switching capacity.

In accordance with a preferred embodiment of the invention, each of the terminals is of a generally L-shaped configuration and has a prong portion extending through a respective slot in the base with a plate portion extending generally parallel with a supporting surface of the base. The plate portions of the terminals with insulators interposed therebetween are assembled in stack form on the base and all but the first terminal have aligned apertures therethrough to allow movement of the second contact therethrough into engagement with the first contact. The bobbin has lugs on a flange thereof projecting through aligned holes in all of the terminal plate portions and the insulators to position the bobbin and the terminals relative to the base. The bobbin and the stack form assembly of the terminals and insulators are retained in position by the bracket which has stud portions projecting from its leg portions that are stacked to the base.

For a better understanding of the invention, reference may be had to the following detailed description taken in connection with the accompanying drawings, in which:

BRIEF DESCRIPTION OF THE DRAWINGS

FIG. A is a side elevation partly in section and with portions broken away of an electromagnetic solenoid relay according to the present intention;

FIG. B is an exploded perspective view of various parts of the relay of FIG. A; and FIG. C is a sectional view taken substantially on line C—C of FIG. A.

DESCRIPTION OF THE PREFERRED EMBODIMENT

Referring now to the drawings, a solenoid relay in accordance with the present invention includes a base 10, three terminals 12, 14, 16 assembled in stack form on the base 10, and an electromagnet 18 mounted on the base 10. A plunger armature 20 is slidably supported in the electromagnet 18 and is biased to an at-rest position shown in FIG. A by a resilient spring 22. A cover 24 may be provided to fit over the relay for protection against dirt and other foreign material.

The base 10 is generally rectangular in shape and may be molded from a suitable insulation material such as a nylon resin. The base 10 has an upper planar supporting surface 26 surrounded by an upstanding rim 28. Two recessed holes 30, 32 are formed in the surface 26 and two locating bosses 34, 36 are formed on the surface 26 adjacent one side of the rim 28. Three slots 38, 40, 42 and a pair of rectangular bores 44, 46 extend through the base 10. The base 10 may also have two projections 48 at its ends which are shaped to seat in corresponding openings 52 in the cover 24.

The terminals 12, 14, 16 which are formed from a ferromagnetic material are mounted upon the base 10. These terminals 12, 14, 16 are each of a generally L-shaped configuration and have respective plate portions 56, 58, 60 overlying the supporting surface 26 of the base 10 and respective prong portions 62,64, 66 by which electrical connections may be made. The prong portions 62, 64, 66 are suitably disposed to extend through the slots 38, 40, 42, respectively, of the base 10. The plate portion 56, 58, 60 are assembled in stack form on the base 10 with an insulator 68 of fish paper or the like interposed between the plate portions 56, 58 and a like insulator 70 interposed between the plate portions 58, 60. The plate portion 56 of the terminal 12 carries an upwardly facing contact 72 of silver or other good contact material which may be welded in place. The plate portions 56, 58 have respective upwardly extending wire connecting posts 74, 76. The plate portion 60 similarly has an upwardly extending spring anchorage post 78. To assure accurate location of the terminals 12, 14, 16 relative to the base 10, each of the plate portions 56, 58 60 and the insulators 68, 70 has a pair of holes 80, 82 therethrough matching the respective pair of holes 30, 32 in the base 10. The plate portions 56, 58, 60 and the insulators 68, 70 each further includes a pair of notches 84, 86 along its edge portions matching the respective pair of bores 44, 46 in the base 10. In addition, each of the plate portions 58, 60 and the insulators 68, 70 is provided with a central aperture 88 therethrough in alignment with the contact 72 on the terminal 12.

The electromagnet 18 comprises a generally U-shaped bracket 90 of ferromagnetic material and a bobbin 92 which may be molded from a suitable insulation material such as a nylon resin. The bobbin 92 includes two end flanges 94, 96 and a central tubular portion 98 about which an electrical energizable coil 100 is wound between the flanges 94, 96. The bobbin 92 has a bore 102 of generally rectangular cross section extending axially through the tubular portion 98 and the end flanges 94, 96. The lower flange 94 is provided with a pair of downwardly extending cylindrical lugs 104, 106 which project respectively through the aligned pairs of holes 80, 82 of the plate portions 56, 58, 60 and the insulators 68, 70 into the recessed holes 30, 32 of the base 10. These lugs 104, 106 are accurately located relative to the bobbin bore 102 to position the bore 102 in alignment with the apertures 88 of the plate portions 58, 60 and the insulators 68, 70. The upper flange 96 is provided With a recessed channel 108 for positioning of the bracket 90 relative to the bobbin 92.

The bracket 90 comprises a pair of parallel leg portions 110, 112 joined by a bight portion 114 which overlies the bobbin end flange 96 and has an opening 116 therethrough in alignment with the bore 102 of the bobbin 92. The leg portions 110, 112 of the bracket 90 are located closely adjacent the edges of the bobbin end flanges 94, 96 and the bight portion 114 is snugly received in the channel 108 of the end flange 96 to accurately position the bobbin 92 relative to the bracket 90. At the respective free ends 118, 120 of the leg portions 110, 112 the bracket 90 has two downwardly extending stud portions 122, 124. These stud portions 122, 124 project, respectively, through the aligned pairs of notches 84, 86 of the plate portions 56, 58, 60 and the insulators 68, 70 and thence through the bores 44, 46 of the base 10 where they are staked over against the lower surface of the base 10. As the free ends 118, 120 of the leg portions 110, 112 are in engagement with the plate portion 60 of the terminal 16, the stack form assembly of the terminals 12, 14 16 and the insulators 68, 70 are trapped between the base 10 and the bracket 90 to obtain rigid securement of the bracket, the terminals and the insulators relative to the base. In addition, the bobbin 92 is retained in position between the plate portion 60 of the terminal 16 and the bight portion 114 of the bracket 90.

The armature 20 is a square prismatic body of ferromagnetic material of rectangular cross section slidably located in the bore 102 of the bobbin 92 for linear reciprocation as hereinafter described. The armature 20 has four flat longitudinal sides 126, 128, 130, 132 extending between two transverse ends 134, 136. All corners of the armature 20 are preferably rounded slightly to ensure free sliding movement of the armature 20 in the bobbin bore 102.

The resilient spring 22 is formed from a strip of spring metal having a conductivity suitable to carry the relay's rated current. One such high conductivity spring material particularly applicable to the spring 22 is a silver-copper alloy marketed by the C. G. Hussey Company as its Type SSC-115 alloy. As shown in FIG. B, the spring 22 is formed with a somewhat J-shaped configuration including a main body portion 138 and an extension portion 140 extending at substantially a right angle from the body portion 138. The extension portion 140 terminates in a hook portion 142 underlying and nearly parallel with the body portion 138. The armature 20 is inserted between the hook portion 142 and the main body portion 138 with the armature side 126 adjacent to and parallel to the extension portion 140. It will be seen from FIG. A that an arm portion 144 at one end of the spring main body portion 138 overlies the end 134 of the armature 20 and is arranged to abut the end 134. The spring hook portion 142 similarly overlies the other end 136 of the armature 20 and is arranged to abut the end 136. With the armature 20 located in the bobbin bore 102, the armature 20 is thus constrained between the hook portion 142 and the arm portion 144 for conjoint motion of the armature 20 and the arm portion 144. The main body portion 138 of the spring 22 is elastically flexed in an arcuate shape and an anchorage end portion 146 is welded to the anchorage post 78 of the terminal 12 with its extremity disposed between the locating bosses 34, 36 on the base 10. The arcuate portion 148 of the spring body portion 138 intermediate the arm portion 144 and the anchorage end portion 146 urges the armature 20 upwardly to an at-rest position as shown in FIG. A.

The lower side of the hook portion 142 carries an electrical contact 150 of silver or other good contact material which may be welded in place. The contact 150 is arranged to engage the contact 72 on the terminal 12 when the armature 20 is attracted downwardly to an actuated position upon energization of the electromagnet coil 100. The hook portion 142 is preferably downturned at a small angle such as 7° relative to the end 136 of the armature 20 to dampen contact bounce as the contact 150 engages the contact 72. Such bounce will be reduced because of the flexing of the hook portion 142 after the contacts first meet with the hook portion 142 diverging from the armature end 136. To dampen noise of operation of the relay, a small cushioning pad 152 of rubber or similar elastomeric material may be interposed between the armature end 136 and the hook portion 142.

It will be observed that the configuration of the relay components provide a compact relay which may be rapidly assembled in a simple manner. The terminal 12 with contact 72 thereon, the terminals 14, 16 and the insulators 68, 70 are assembled in stack form on the base 10, and the bobbin 92 carrying the coil 100 is mounted upon the terminal 16 with its lugs 104, 106 protruding through the stacked parts into the recessed holes 30, 32 of the base 10. The bracket 90 is positioned over the bobbin 92 with the ends 118, 120 of its leg portions engaging the terminal 16 and the stud portions 122, 124 extending through the bores 44, 46 of the base 10. The stud portions 122, 124 are then staked against the base 10 to secure all the parts in assembled relation. The leads 154 of the coil 100 may then be connected to the respective wire connecting posts 74, 76 of the terminals 14, 16. The armature 20 and the cushioning pad 152 may be inserted between the body portion 138 and the hook portion 142 of the spring 22 to which the contact 150 was previously attached. After insertion of the united armature 20 and hook portion 142 through the bracket opening 116 into the bobbin bore 102, the spring 22 is flexed to an arcuate shape and its anchorage end portion 146 is welded to the anchorage post 78 of the terminal 16. Because the anchorage end portion 146 is located at a predetermined position with its extremity against the base 10, the resilient force exerted by the spring 22 on the armature 20 will be substantially uniform in like relays. Thus, the relay pull-in or pick-up voltage will be substantially constant from one relay to another. Finally the cover 24 is placed over the relay assembly with the projections 48 on the base 10 received over the relay assembly.

In operation of the relay, the terminal 12 is connected to one pole of a battery or another source of electrical potential. The terminal 16 is connected in a circuit to the other pole of the battery under the control of the relay, and the terminal 14 is connected in another circuit to the other pole of the battery for energizing the coil 100 from the battery. Upon energization of the coil 100, a magnetic flux path is established which extends through the armature 20, the bight portion 114 and leg portions 110, 112 of the bracket 90, and the air gap defined between the terminals 12 14, 16 and the lower end 136 of the armature 20. The armature 20 thus is magnetically attracted toward the terminals 12, 14, 16 and will slide downwardly in the bobbin bore 102 to an actuated position in which the contact 150 engages the contact 72. As the armature 20 is axially constrained between the arm portion 144 and the hook portion 142 of the spring 22 for conjoint motion of the armature and the arm portion, the arcuate portion 148 of the spring 22 is flexed throughout its length. Because the armature 20 and the spring 22 are held together in operative relation solely by abutting engagement therebetween, there is a freedom of motion between the armature and the spring which permits the armature 20 to align itself in the bobbin bore 102 of the electromagnet 18. This free floating self aligning motion of the armature 20 ensures that the armature will not tilt or cock thus assuring engagement of the contacts 150, 72 with the desired kinetic force.

When the current to the coil 100 is interrupted, the armature 20 is released from its actuated position and is urged to its at-rest position by the return force of the spring 22. The armature 20 has a free floating motion through the bobbin bore 102 during this return movement so that the off-set force of the spring 22 with respect to the contact axis is effective to separate the contacts 150, 72 in case contact 150 should be stuck or tack welded to the contact 72. Since the hook portion 142 of the spring 22 is flexed as a consequence of the engagement of the contacts 72, 150 in the actuated position of the armature 20, the hook portion 142 further exerts a resilient force between the contacts 72, 150 which in case of tack welding therebetween overcomes the tack welding with a shearing force during return movement of the armature 20. Because contacts 72, 150 are disposed in the air gap between the armature 20 and the terminals 12, 14, 16 there is a substantial magnetic flux field immediately adjacent the contacts. This blowout effect acts to suppress arcing at the contacts and substantially increases the electrical life of the contacts.

While there has been described above the principles of this invention in connection with a specific relay construction, it is to be understood that this description is made only by way of example and not as a limitation to the scope of the invention.

What is claimed is:

1. In an electromagnetic solenoid relay having a base structure;

an electromagnet mounted on said base structure, said electromagnet having a bore extending axially therethrough and including coil means adapted for electrical energization;

a plunger armature having spaced transverse ends and longitudinal sides therebetween, said armature being slidably supported in said bore of the electromagnet for linear reciprocation between an at-rest position and an actuated position upon the energization and deenergization of said coil means; and a resilient spring in engagement with said armature and secured to said base structure for urging said armature to its at-rest position, said spring comprising a continuous length of spring strip metal and having an arcuate portion extending between an anchorage portion fixed to said base structure and an arm portion extending to one end of said armature;

the improvement wherein:

said one arm portion of the spring overlies said one end of said armature and is arranged so as to abut said one end;

said spring including an integral extension portion extending at substantially a right angle from said arm portion into said bore and disposed substantially parallel with a side of said armature, said extension portion terminating in an integral hook portion overlying the other end of said armature and arranged so as to abut said other end;

said armature being axially constrained between said arm portion and said hook portion of said spring for conjoint motion of said armature and said arm portion whereby said spring is effective to urge said armature to its at-rest position upon deenergization of said coil means; and said armature and said spring being held together in operative relation solely by abutting engagement therebetween whereby there is a freedom of motion between said armature and said spring permitting the armature to align itself with the electromagnet upon energization of said coil means.

2. An electromagnetic solenoid relay comprising;

a base;

an electromagnet mounted on said base, said electromagnet including a bobbin having a bore extending axially therethrough, and an electrically energizable coil wound on said bobbin;

a plunger armature having spaced transverse ends and longitudinal sides therebetween, said armature being slidably located in said bore of the bobbin for linear reciprocation between an at-rest position and an actuated position upon the energization and deenergization of said coil;

a resilient spring in engagement with said armature and secured to said base for urging said armature to its at-rest position, said spring comprising a continuous length of spring strip metal and having an arcuate portion extending between an anchorage end portion fixed to said base and and arm portion overlying one end of said armature and arranged so as to abut said one end, said spring further including an integral extension portion extending at substantially a right angle from said arm portion into said bore and disposed substantially parrallel with a side of said armature, said extension portion terminating in an integral hook portion overlying the other end of said armature and arranged so as to abut said other end, said armature being axially constrained between said arm portion and said hook portion of the spring for conjoint motion of said armature and said arm portion whereby said spring is effective to urge said armature to its at-rest position upon deenergization of said coil, said armature and said spring being held together in operative relation solely by abutting engagement therebetween whereby there is a freedom of motion between said armature and said spring permitting the armature to align itself with said electromagnet upon energization of said coil;

first and second terminals mounted on said base;

a first contact on said first terminal;

a second contact on said hook portion of the spring arranged to engage said first contact upon movement of said armature to its actuated position and to disengage from said first contact upon return of said armature to its at-rest position; and means connecting said anchorage portion of said spring to said second terminal.

3. The electromagnetic solenoid relay as defined in claim 2 wherein:

said electromagnet includes a substantially U-shaped ferromagnetic bracket having a pair of parallel leg portion extending from said base alongside said bobbin and joined by a bight portion overlying one end of said bobbin, said bight portion having an opening therethrough in alignment with said bore for passage of said armature therethrough;

at least said first terminal being mounted on said base intermediate said leg portions and formed of a ferromagnetic material whereby there is established a magnetic flux path extending through said bracket, said armature and said first terminal when said coil is energized; and said first and second contacts being disposed in a gap in said flux path between said first terminal and said other end of the armature such that the magnetic flux field in said gap acts to produce a magnetic blowout effect at said first and second contact.

4. The electromagnetic solenoid relay as defined in claim 3 wherein:

a third terminal is mounted on said base to provide an electrical connection to said coil;

said base being formed of insulating material and having a planar supporting surface;

said first, second and third terminals each being of a generally L-shaped confirguration and having a prong portion extending through a respective slot in said base with a plate portion extending generally parallel with said supporting surface of the base;

a first insulator interposed between the plate portions of said first and third terminals;

a second insulator interposed between the plate portions of said third and second terminals;

all of said plate portions and said insulators being assembled in stack form upon the supporting surface of said base;

said insulators and the plate portions of said second and third terminals having apertures therethrough in alignment with said first and second contacts to allow engagement of said contacts upon movement of said armature to its actuated position;

first and second end flanges disposed respectively at said one end and the other end of said bobbin;

said second flange having two lugs thereon projecting through aligned holes formed in all of said terminal plate portions and said insulators and into aligned further holes formed in said base to position said bobbin and said terminals relative to said base;

said stack form assembly of terminals and insulators being trapped between said base and the free ends of said leg portions of the bracket opposite said bight portion;

said bracket having stud portions projecting from said leg portions through said base and staked at the ends thereof to said base to obtain rigid securement of said bracket, said terminals, said insulators and said base with each other;

said bobbin being retained in position between the plate portion of said second terminal and the bight portion of said bracket.

5. The electromagnetic solenoid relay as defined in claim 4 wherein all of said terminals are formed of ferromagnetic material and said magnet flux path extends through the plate portions of all of said terminals.

6. The electromagnetic solenoid relay as defined in claim 2 wherein said hook portion is resilient and normally extends substantially linearly over said opposite end of said armature at a small angle on the order of about 7° relative to said opposite end of said armature except when said first and second contacts are engaged upon movement of said armature to its actuated position whereupon said hook portion is flexed as a consequence of said contact engagement to exert a resilient force between said contacts.

* * * * *